US005879510A

United States Patent [19]

Hägglund et al.

[11] Patent Number: 5,879,510

[45] Date of Patent: Mar. 9, 1999

[54] LIGHT DRAINABILITY, BULKY CHEMIMECHANICAL PULP THAT HAS A LOW SHIVE CONTENT AND A LOW FINE-MATERIAL CONTENT

[75] Inventors: Tjell-Ake Hägglund, Söråker; Ingela Ekebro, Sundsvall; Hans Höglund, Matfors; Roland Back, Njurunda, all of Sweden

[73] Assignee: SCA Hygiene Products AB, Goteborg, Sweden

[21] Appl. No.: 750,527

[22] PCT Filed: Jun. 7, 1995

[86] PCT No.: PCT/SE95/00670

§ 371 Date: Dec. 13, 1996

§ 102(e) Date: Dec. 13, 1996

[87] PCT Pub. No.: WO95/34711

PCT Pub. Date: Dec. 21, 1995

[30] Foreign Application Priority Data

Jun. 15, 1994 [SE] Sweden ..... 9402101-1

[51] Int. Cl.[6] ..... D21B 1/02

[52] U.S. Cl. ..... 162/25; 162/26; 162/28; 162/19; 162/24; 162/78; 162/76; 162/55

[58] Field of Search ..... 162/25, 26, 28, 162/17, 19, 55, 83, 84, 78, 88

[56] References Cited

U.S. PATENT DOCUMENTS

| | | | |
|---|---|---|---|
| 3,661,328 | 5/1972 | Leask | 241/18 |
| 4,244,778 | 1/1981 | Lindahl et al. | 162/17 |
| 4,279,694 | 7/1981 | Fritzvold et al. | 162/28 |
| 4,294,653 | 10/1981 | Lindahl et al. | 162/25 |
| 4,486,267 | 12/1984 | Prusas | 162/25 |
| 4,562,969 | 1/1986 | Lindahl | 241/21 |
| 4,938,843 | 7/1990 | Lindahl | 162/55 |

FOREIGN PATENT DOCUMENTS

| | | |
|---|---|---|
| 27 14 730 | 10/1977 | Germany . |
| 397851 | 11/1977 | Sweden . |
| 460060 | 12/1991 | Sweden . |
| WO 91/12367 | 8/1991 | WIPO . |

OTHER PUBLICATIONS

Hans Hoglund et al., "Modified thermo–mechanical pulp", *Svensk Papperstidning*, vol. 79, No. 11, 1976, pp. 343–347 and 353.

*Primary Examiner*—Stanley S. Silverman
*Assistant Examiner*—José S. Fortune
*Attorney, Agent, or Firm*—Young & Thompson

[57] ABSTRACT

A chemimechanical pulp for use in the manufacture of paper or paperboard products where a high drainability, bulky pulp is desired. The pulp has a long fiber content of between 60 and 75%, a fine-material content of at most 14%, a shive content of less than 0.5%, is refined to a freeness of 600 ml CSF at the lowest, and has a tensile index of at least 10 kNm/kg. A method for producing such a pulp comprises: a) impregnating chips with a lignin softening chemical; b) preheating the chips; c) refining the chips to papermaking pulp; wherein the chips are impregnated and heated over a total time period of at most 4 minutes; a) using a hot impregnating liquid having a temperature of at least 130° C.; b) preheating the chips at a temperature above the lignin softening temperature; c) refining the pulp in one or more stages, of which the first or sole stage is carried out solely at essentially the same pressure and the same temperature as the preheating process; and refining the pulp at a total energy input which is at least 50% and at most 90% of the energy input required to achieve the same shive content when preheating at 135° C. and using the same machine equipment.

22 Claims, 9 Drawing Sheets

LIGHT DRAINABILITY, BULKY CHEMIMECHANICAL PULP THAT HAS A LOW SHIVE CONTENT AND A LOW FINE-MATERIAL CONTENT

FIELD OF THE INVENTION

The present invention relates to a long-fiber, readily dewatered, bulky, high yield chemimechanical pulp produced from lignocellulosic fiber material at a high yield (>88%) and having a low shive content, low fine-material content and an extract content of less than 0.15%. The invention also relates to a method of producing the pulp.

BACKGROUND OF THE INVENTION

In certain paper products it is advantageous to be able to achieve the highest possible bulk (low bulk density) at a given strength while satisfying high requirements placed on the surface properties of the products. Examples of such products are tissue products, with which high liquid absorption is a preferential property, and paperboard material or so-called liners for corrugated fiberboard boxes, with which a high degree of flexural rigidity is desired.

High bulk is, of course a necessary factor in achieving high liquid absorption. High bulk also contributes positively to the rigidity or stiffness of the board and the liner products. Since high requirements are also placed on the surface properties of this type of product, i.e. properties which will impart smoothness and softness to tissue products and enable print to be applied easily to the surfaces of paperboard and liners the shive content of the pulps used must be extremely low. The requirement of a low shive content and a given lowest mechanical strength has hitherto limited the possibility of using the most extremely long-fiber chemimechanical pulps of low fine-material contents, which provide the bulkiest products. The methods hitherto known for the production of extremely long-fiber chemimechanical pulps have resulted in pulps which are too weak or in which the coarse shive content is much too high.

High yield mechanical and chemimechanical pulps (>88%) are characterized in that the long whole fibers in the pulp (measured for instance as the fraction captured on a 30 mesh (Tyler standard) wire when fractionating in a Bauer McNett-apparatus) have a high flexural rigidity, which is also a prerequisite for manufacturing products which have a very high bulk. In order to produce pulp whose strength properties are sufficiently good for the pulp to be used in the manufacture of tissue, paperboard or liner products for instance, it has also been necessary hitherto for mechanical and chemimechanical pulp to contain a very high proportion of fiber fragments and fine-material, since these materials function as a binder between the long, stiff fibers. When fractionating in a Bauer McNett-apparatus, it has hitherto been considered necessary for the fine-material content, which is normally characterized as the fraction that can pass through a 200 mesh wire (Tyler standard), to be greater than 10%, preferably greater than 12%, in order to be able to obtain strength properties that are sufficiently good for use in tissue, fiberboard or liner products. Another reason why it has hitherto been considered necessary for mechanical or chemimechanical pulps to contain more than 12% fine-material is because at least this amount is formed nevertheless when working the pulp to reduce its shive content (measured according to Somerville with a 0.15 mm mesh width) to levels that are sufficiently low (less than 0.50%, preferably less than 0.25%) to obtain the desired surface properties.

SE-B-397 851 teaches a method of producing a chemimechanical pulp in which the chips are first impregnated with an alkaline sodium sulphite solution and then preheated with steam at 135°–170° C. for about 10 minutes. The following refinement is effected in an open refiner at a temperature slightly above 100°C. The pulp is refined to 400 ml CSF and a very low shive content is obtained. Thus, when practicing this known method it is elected to refine at a relatively low temperature, i.e. a temperature which is much lower than the so-called lignin softening temperature. A relatively high energy input is then required in the refining process in order to obtain a low shive content, which results in a high percentage of fine-material in the pulp. The low shive content is only obtained at a relatively low freeness level. The long preheating time easily leads to a pulp of low brightness, particularly at the longest of these preheating times.

WO-Al-91/12367 describes an absorbent chemimechanical pulp that is manufactured from lignocellulosic material at an extremely low energy input, at a wood yield above 88%, a long fiber content above 70%, preferably above 75%, a fine-material content below 10% and a shive content below 3%. The pulp is produced by preheating and impregnating the chips at high temperature, high pressure and over a short period of time in one and the same vessel, prior to defibering the wood. When producing chemimechanical pulp with the method according to WO-Al-91/12367 at a long fiber content >70% and in which the energy input is maintained at an extremely low level in the refining process, there is often obtained a pulp whose shive content is too high and its strength too low (<10 kNm/kg) for the pulp to be used beneficially in paper products that are required to have high mechanical strength.

By "energy input" is meant in the following the input of electrical energy when refining the fiber material (unless stated differently, the term energy input refers to the total energy input in the single refining stage or in all refining stages). The term "refinement or refining" refers both to the coarse separation of the fibers (defibration) and to working of the fibers (refinement in its true meaning). By "yield" is meant the pulp yield calculated on the fibrous starting material, such as barked wood for instance.

SUMMARY OF THE INVENTION

It has now surprisingly been found possible to produce a bulky (density suitably lower than 400 kg/m$^3$, preferably lower than 325 kg/m$^3$, and more preferably lower than 275 kg/m$^3$) chemimechanical pulp at a yield greater than 88% and an extract content of less than 0.15%, wherein the inventive pulp presents good strength properties (tensile index above 10 kNm/kg, preferably above 15 kNm/kg, and particularly above 20 kNm/kg) and a very low shive content (less than 0.5%, preferably less than 0.25% and more preferably less than 0.10%) at a low fine-material content (at most 14% according to BMN <200 mesh (Tyler Standard), preferably at most 10%), a high long-fiber content (between 60 and 75% according to BMN >30 mesh, preferably between 62 and 72% and more preferably between 63 and 70%) and a high freeness (at least 600 ml CSF, preferably at least 650 ml CSF, and more preferably at least 700 ml CSF and particularly at least 720 ml CSF). It has also been found that this pulp can be used to advantage in tissue, paperboard or liners and produces products of desired high bulk or stiffness of sufficient strength, while enabling the demand for good surface properties to be satisfied at the same time.

In the following, the chemimechanical pulps produced in accordance with the invention will be referred to as "HT- CTMP" (High Temperature ChemiThermoMechanical Pulp). Standard chemimechanical pulps are referred to as standard CTMP.

The fiber starting material from which the chemimechanical pulp is produced in accordance with the invention may comprise any lignocellulosic material, for instance grass (such as Sesbania) or wood. Suitably softwood, such as spruce, is used.

According to the present invention there is obtained a suitable combination of valuable properties by a) impregnating chips produced from the lignocellulosic material with one or more lignin softening chemicals, such as sulphite, for instance, sodium sulphite, dithionite, for instance sodium dithionite, or an alkaline peroxide, b) preheating the chips, c) refining the chips to produce papermaking pulp, d) suitably extracting excessive coarse fiber material in a screen room and returning said material for further processing, wherein the chips are impregnating and preheated over a total time period of at most 4 minutes, particularly at most 3 minutes, and preferably at most 2 minutes, and wherein a) there is used a hot impregnating liquid having a temperature of at least 130° C., suitably at least 150° C. and preferably of essentially the same temperature as the preheating temperature, b) the impregnated chips are preheated at a temperature above the lignin softening temperature (suitably at a temperature of 150°–190° C., preferably 160°–175° C., when the fiber starting material is softwood) and wherein c) the refining process is carried out in one or more stages of which the first, or the sole, stage is carried out at essentially the same pressure and the same temperature as the preheating stage and with an energy input which is at least 50% and at most 90%, particularly 60–80%, of the energy input that is required when preheating the chips at a temperature of 135° C. to achieve the same shive content in the same type of mechanical equipment.

Impregnation and preheating of the chips may conveniently be effected over a total time period of 1 minute or shorter, particularly 0.5 minute or shorter. The impregnation and preheating process are suitably carried out in one and the same vessel.

When the fiber starting material is softwood, the total energy input of the refining process will suitably be at least 300 kWh/ton, preferably at least 500 kWh/ton and particularly at least 600 kWh/ton. The total energy input of the refining process will then suitably be at most 1200 kWh/ton, preferably at most 1100 kWh/ton and particularly at most 1000 kWh/ton.

The energy input is determined on each occasion to obtain desired pulp parameters.

Both preheating and refining of the chips in the first stage is effected at temperatures above the lignin softening temperature. The preheating temperature is suitably at least 140° C. At relevant working frequencies in a conventional refiner when the starting material is softwood, the lignin softening temperature will lie in the range of 130°–140° C. (ref. 1–8). Further refinement of the pulp is suitably carried out at lower temperatures than those used in the first stage.

The lignin softening temperature can be determined by mechanical spectroscopy in accordance with various well known methods (ref. 1–5). The lignin softening temperature can be adjusted downwards after impregnating with different softening chemicals (ref. 6–8), for instance with sulphite, such as sodium sulphite, dithionite, such as sodium dithionite, alkaline peroxide or some other lignin softening chemical, as is also the case in the chemimechanical processes most relevant to the invention.

However, in order for the chemimechanical pulp to provide the desired combination of properties at such high yield levels (higher than 88%), it is necessary to have worked its long fibers to a suitable high degree of flexibility without forming high percentages of fine-material at the same time. Fiber flexibility is preferably achieved by causing the initially too rigid fibers to collapse, either completely or partially, in the manufacturing process. When producing pulp in accordance with the present invention, this is achieved by refining adequately softened chips in a first stage with a suitable energy input and at temperatures which exceed the so-called softening temperature of the lignin (ref. 1–8).

The degree of collapse of long, whole fibers captured on a 30 mesh wire when fractionating according to Bauer McNett and produced under the aforesaid conditions have been measured in an electron microscope. The degree of collapse of dried fibers has been detected as the change in the lumen of the pulp fibers according to FIG. 1. The results are presented in Table 1 and show that the dried fibers in HT-CTMP have collapsed to a greater extent than corresponding fibers in standard CTMP. This is true despite the fact that the freeness value, which is considered as a reverse measurement of the workability of the pulp, is lower for the standard pulp than for the pulps produced in accordance with the invention.

TABLE 1

| | HT CTMP Ex. 1 | HT CTMP Ex. 2 | Standard |
|---|---|---|---|
| Preheat temp., °C. | 170 | 170 | 135 |
| Total energy input, kWh/t | 950 | 680 | 1300 |
| Freeness, ml | 660 | 720 | 554 |
| Bauer McNett | | | |
| >30 mesh, % | 65.3 | 67.6 | 59.9 |
| <200 mesh, % | 7.7 | 7.5 | 13.5 |
| Shive content Somerville, % | 0.04 | 0.08 | 0.15 |
| Mean lumen long fiber, μm | 6.1 | 6.8 | 7.8 |

DESCRIPTION OF THE PREFERRED EMBODIMENTS

Comparisons are made in FIGS. 5–15 and in Tables 3–5 between HT-CTMP-pulps and various commercial chemimechanical CTMP-type pulps that are used at present in the manufacture of tissue and paperboard materials. The different HT-CTMP-pulps have been obtained by varying the energy inputs and the refining disk patterns in the refining process. The pulps designated Scandinavian have all been produced in plants in which the first refining stage was carried out in a single-disk refiner from the machine supplier Sunds Defibrator, after preheating spruce chips at temperatures beneath 145° C. (ref. 9–11). The pups designated Östrand were produced in a commercial CTMP-plant (FIG. 4), in which the first refining stage was carried out in a twin-disk refiner of the type RSB 1300 from Sunds Defibrator, after preheating the chips at temperatures beneath 140°C. The preheating time was about 3 minutes (ref. 9). The pulps designated Canadian were all manufactured from Canadian spruce chips in single-disk refiners. These pulps were also preheated at temperatures below 145° C. (ref. 11).

Figure 1:
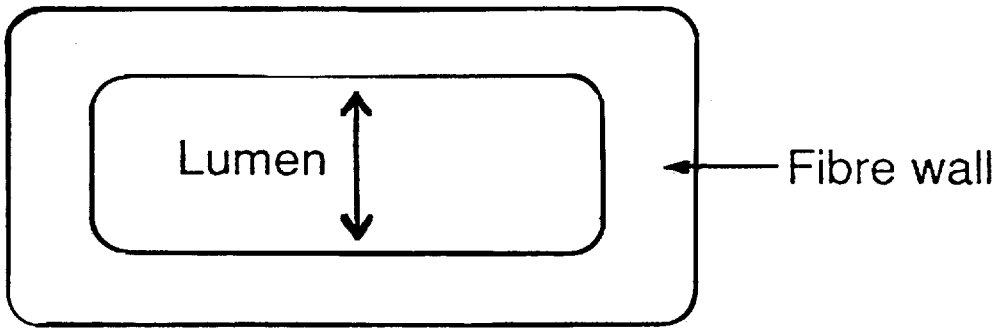
FIG. 1 is a cross-section sketch of a fiber and shows the lumen of the fiber.

FIG. 1 is a cross-section sketch of a fiber and shows the lumen of the fiber.

Figure 2:
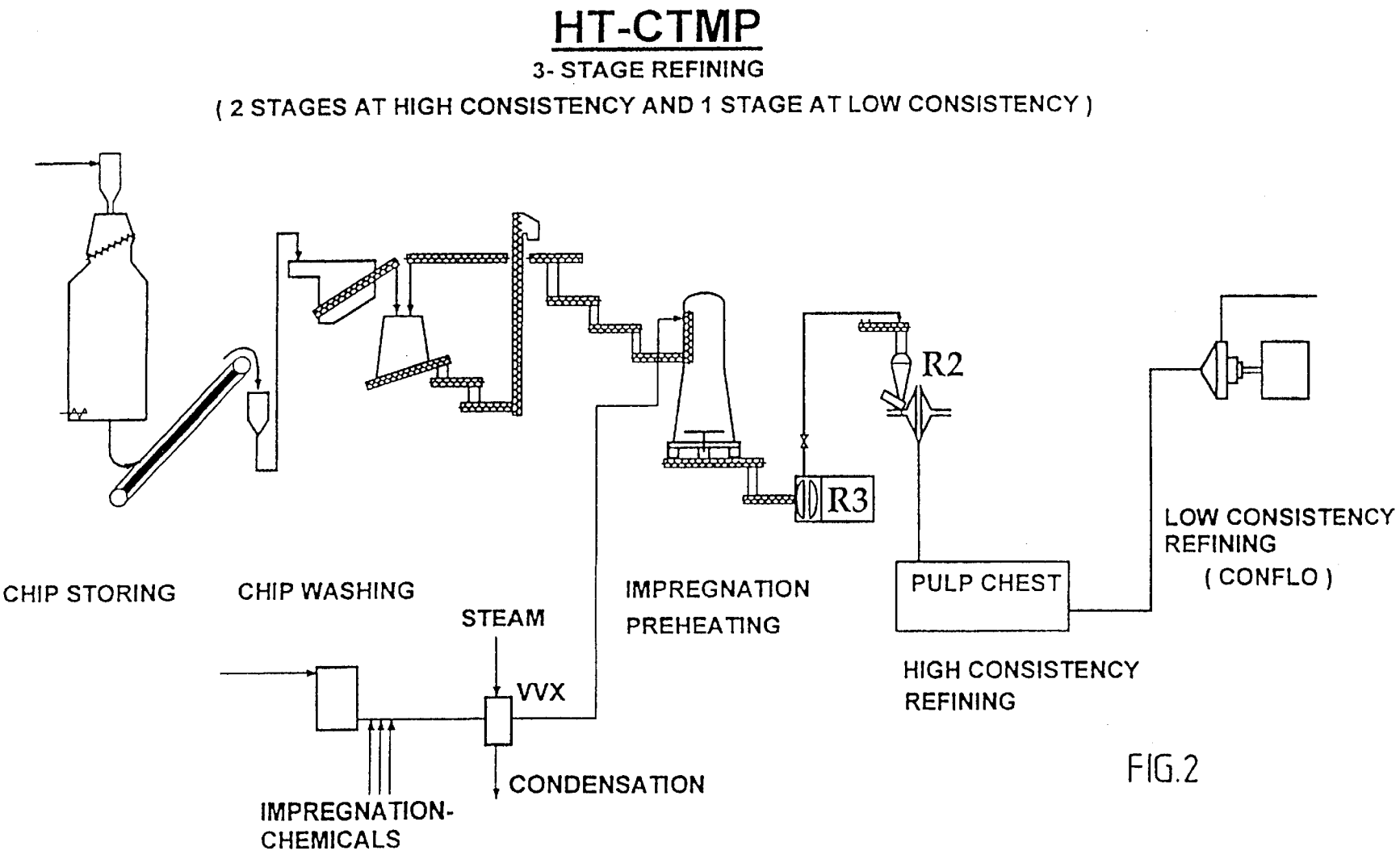
FIG. 2 is a process chart which illustrates one example of a pulp manufacturing process in accordance with the invention.

FIG. 2 is a process chart which illustrates one example of a pulp manufacturing process in accordance with the invention. In this case, the pulp is refined in a total of three stages, two stages at high consistencies and one stage at low consistency (Conflo).

Figure 3:
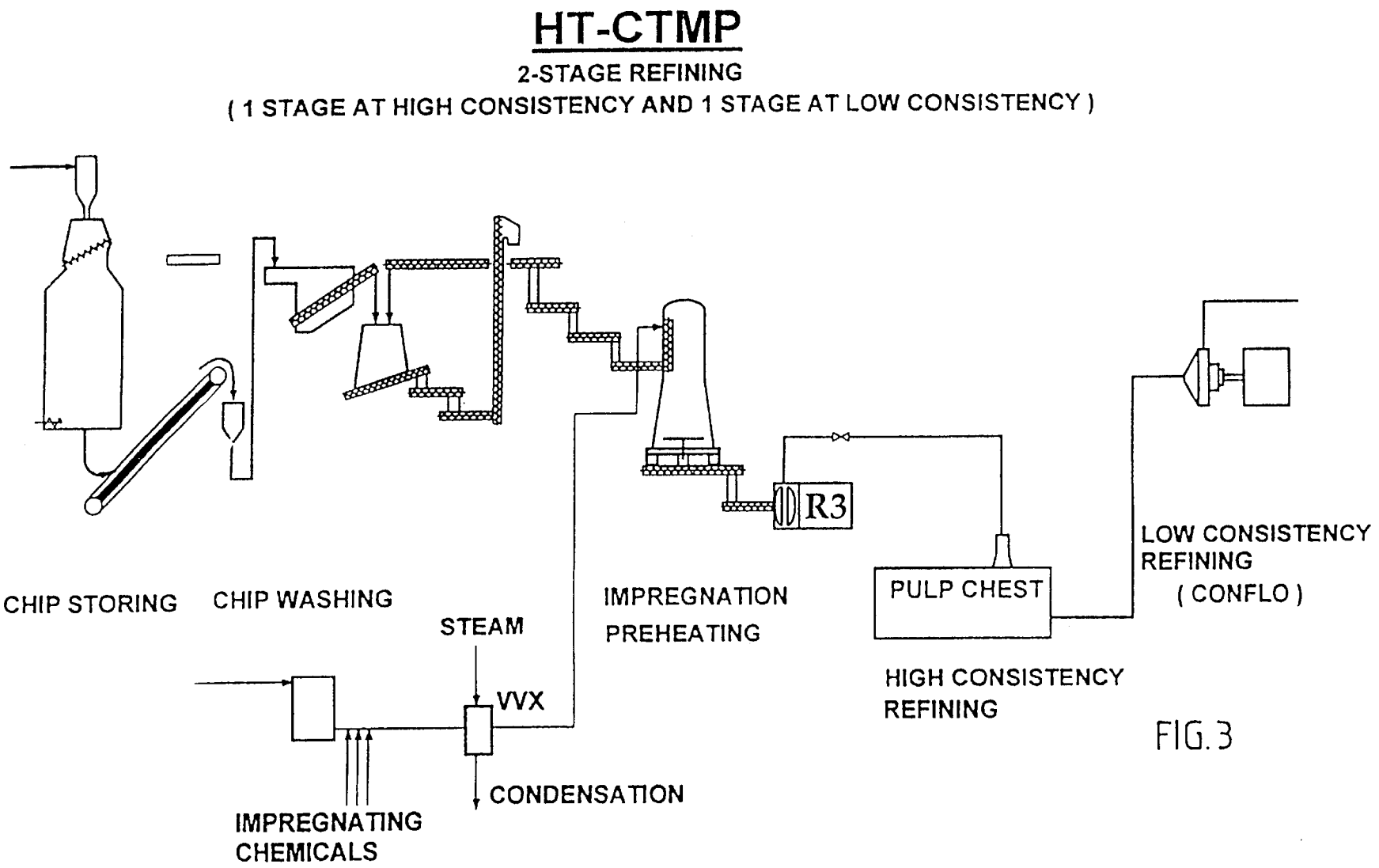
FIG. 3 is a process chart which illustrates another example of an inventive pulp manufacturing process.

FIG. 3 is a process chart which illustrates another example of an inventive pulp manufacturing process. In this case, the pulp is refined in a total of two stages, one stage at high consistency and one stage at low consistency (Conflo).

Figure 4:
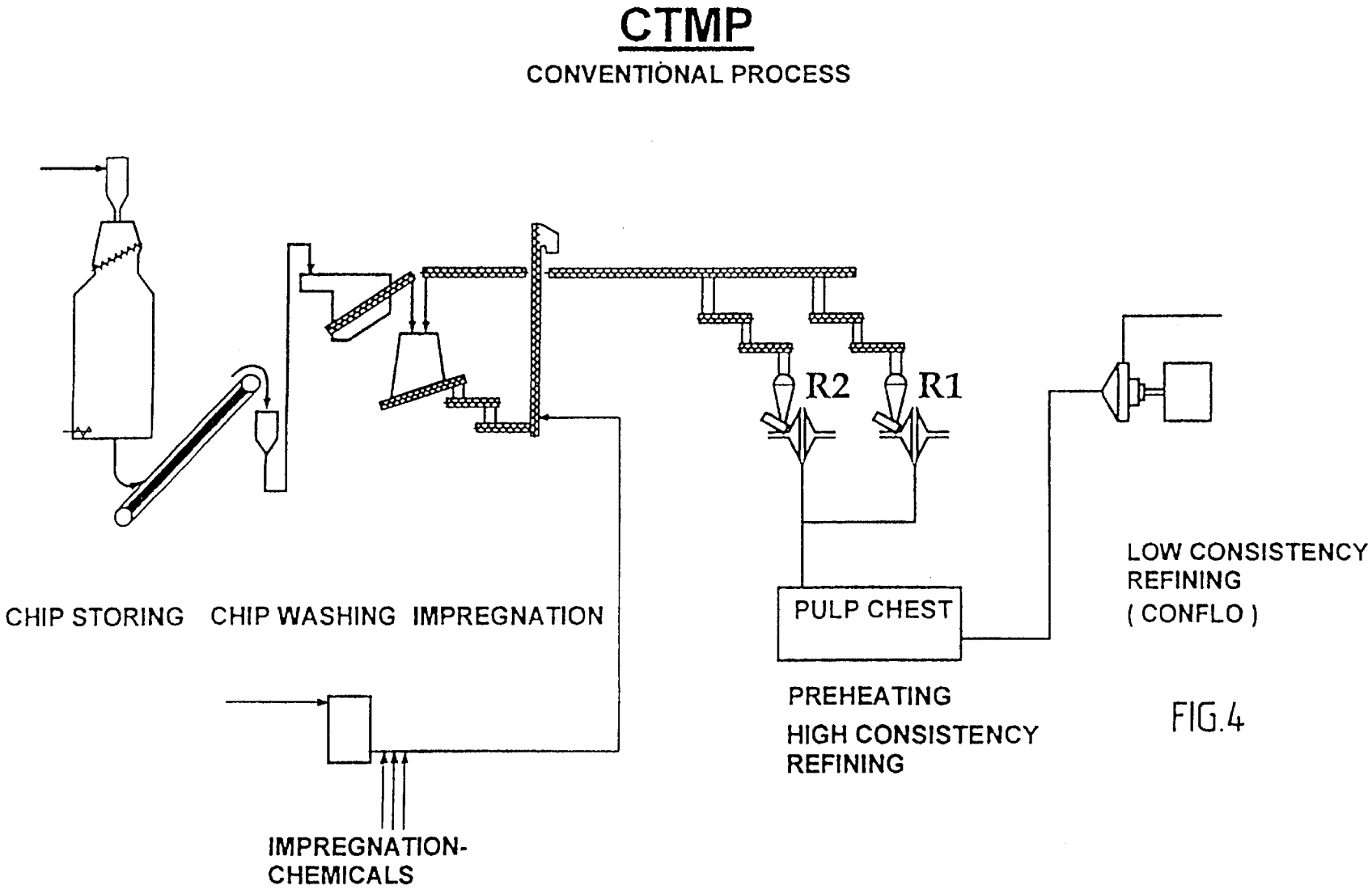
FIG. 4 illustrates a plant machinery for the manufacture of conventional CTMP-type chemimechanical pulps.

FIG. 4 illustrates plant machinery for the manufacture of conventional CTMP-type chemimechanical pulps, these pulps being designated Östrand in FIGS. 1–15. In this case, the pulp is refined in a total of two stages, one stage at high consistency and effected in two parallel-connected refiners, and one stage at low consistency (Conflo).

Figure 5:
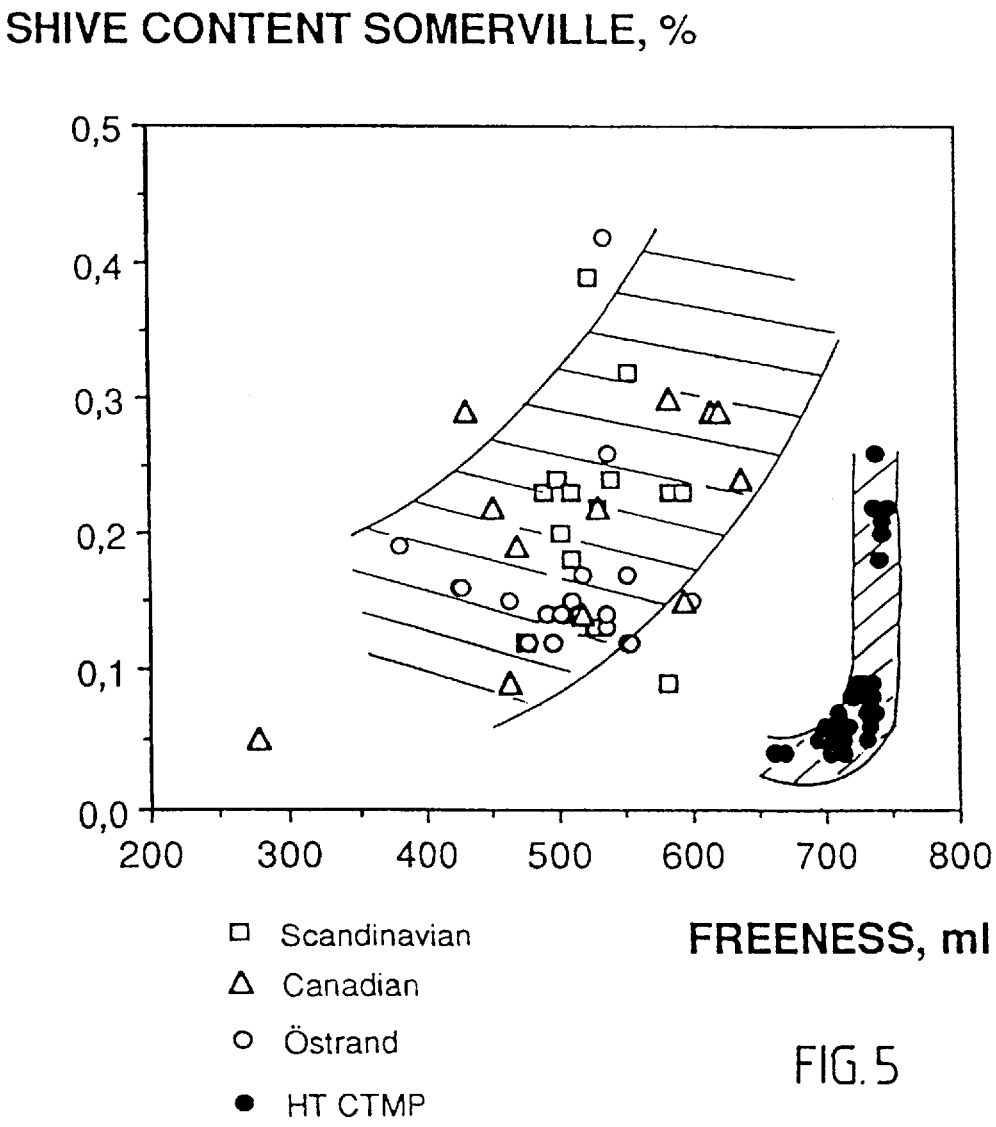
FIG. 5 is a diagram showing the shive content as a function of freeness for a number of chemimechanical CTMP-type pulps.

FIG. 5 is a diagram showing the shive content as a function of freeness for a number of chemimechanical CTMP-type pulps. The Figure shows that it is possible to produce high drainability (high freeness (CSF)) pulps having an extremely low shive content in high yields when practicing the inventive method.

Figure 6:
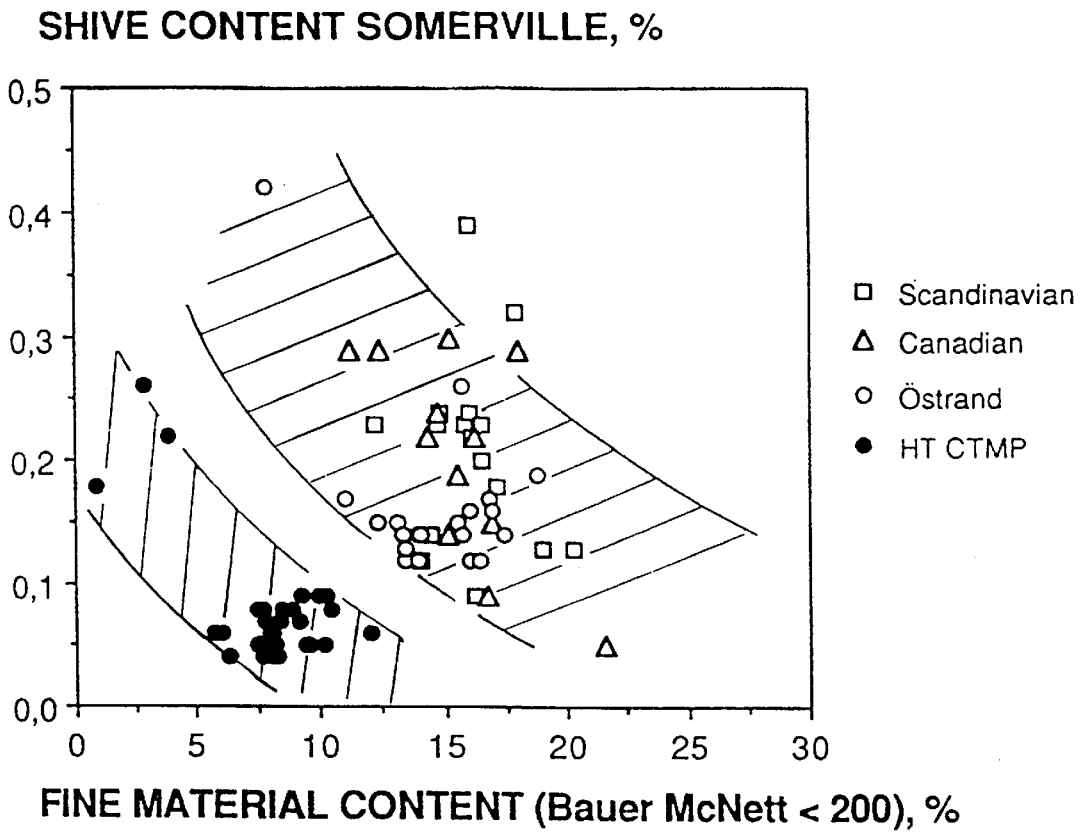
FIG. 6 is a diagram which shows the shive content as a function of the fine-material content for a number of CTMP-type chemimechanical pulps.

FIG. 6 is a diagram which shows the shive content as a function of the fine-material content for a number of CTMP-type chemimechanical pulps. The Figure shows that the extremely low shive content of the pulps produced in accordance with the invention is achieved without forming large quantities of fine-material. The fine-material content, according to BMN <200 mesh, can be kept beneath 14%, preferably beneath 10%.

Figure 7:
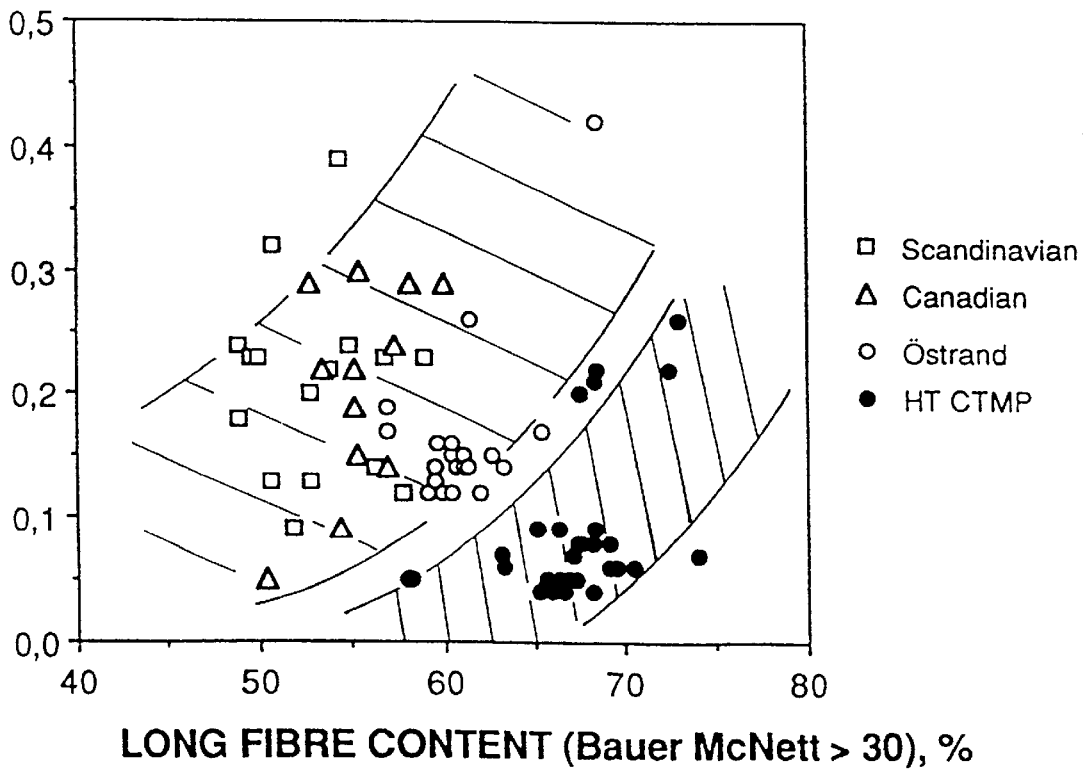
FIG. 7 is a diagram showing the shive content, according to Somerville, as a function of the long fiber content.

FIG. 7 is a diagram showing the shive content, according to Somerville, as a function of the long fiber content. The long fiber content of the pulps produced in accordance with the invention can be kept high despite the extremely low shive contents of the pulps, which is a prerequisite for manufacturing pulp having the desired high bulk levels.

Figure 8:
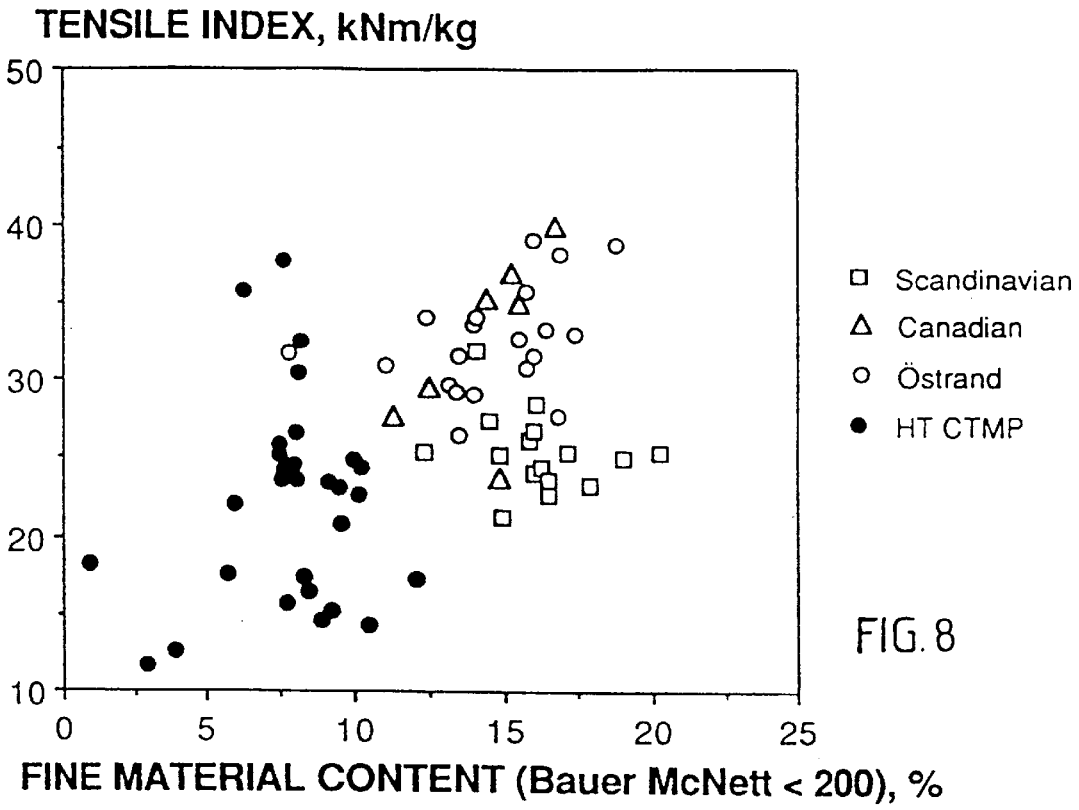
FIG. 8 shows the tensile index as a function of the fine-material content.

FIG. 8 shows the tensile index as a function of the fine-material content. A sufficiently high mechanical strength (tensile index >10 kNm/kg, preferably >15 kNm/kg) can be achieved without large quantities of fine-material in pulps produced in accordance with the invention. This shows that the long whole fibers in the inventive pulp have been given sufficiently high flexibility. The percentage of fine-material according to Bauer McNett can be kept beneath 14%, preferably beneath 10%, while, at the same time, achieving the same strength level as that which can be achieved with present day techniques for the manufacture of CTMP-type chemimechanical pulp. The percentage of fine-material is significantly higher, however, when applying the conventional techniques.

Figure 9:
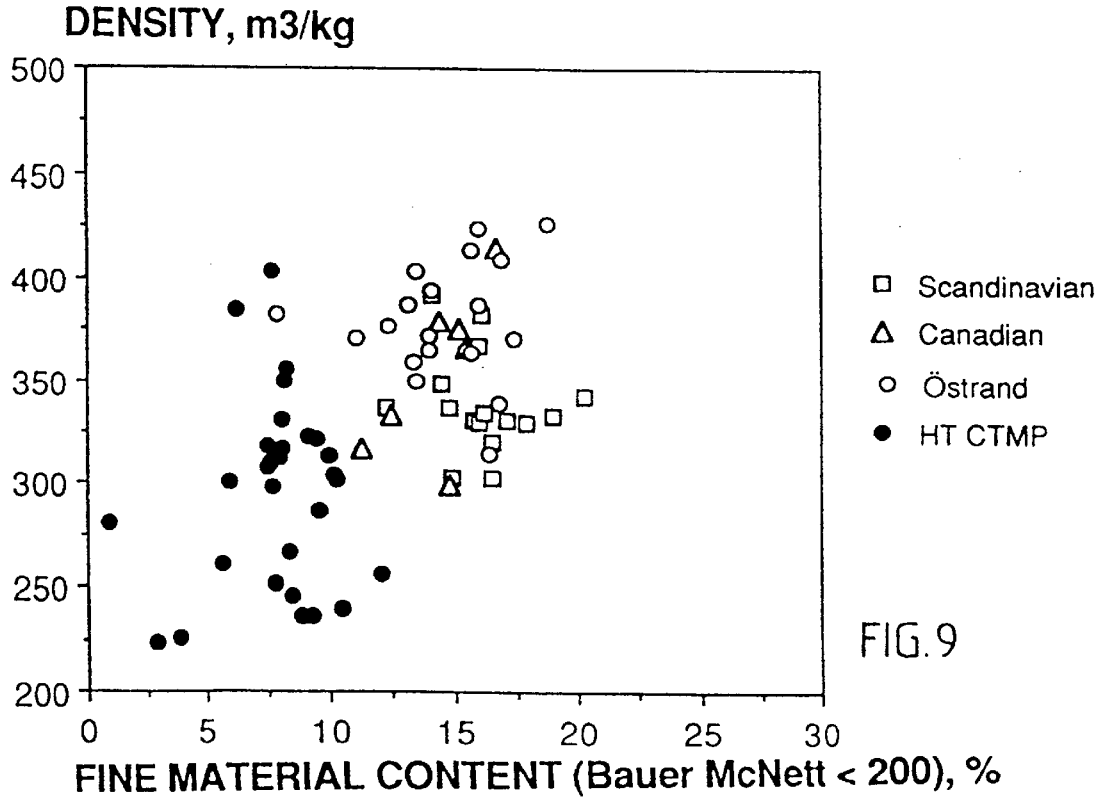
FIG. 9 shows the density as a function of the fine-material content.

FIG. 9 shows the density as a function of the fine-material content. The highest bulk levels (density lower than 275 $kg/m^3$) can not be achieved until the pulps have a low fine-material content, which is shown to advantage with the novel technique according to the invention.

Figure 10:
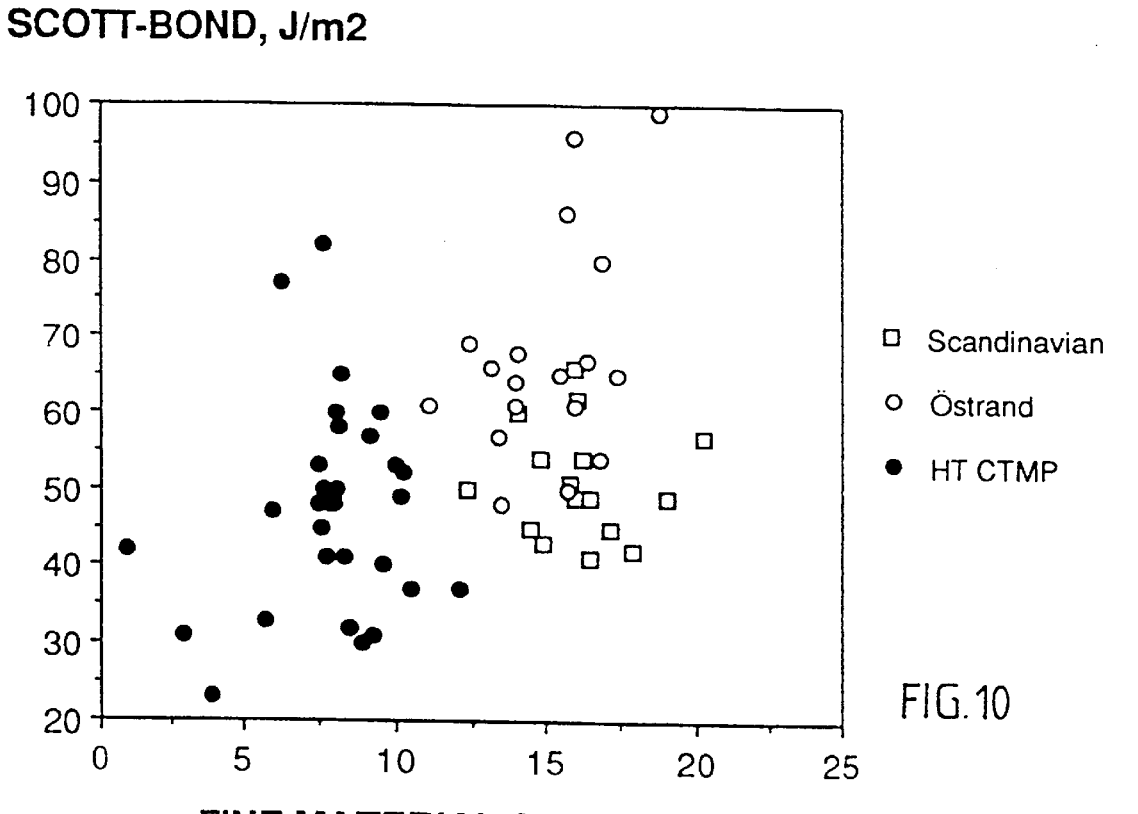
FIG. 10 shows the Scott Bond value as a function of fine-material content.

FIG. 10 shows the Scott Bond value as a function of fine-material content. The Scott Bond value is of great importance to the production of pulps that are intended for paperboard manufacture. It is necessary to obtain sufficiently high Scott Bond values in order to obtain high binding strengths in layered paperboard constructions. The Figure shows that when practicing the inventive technique, it is possible to achieve sufficiently good values without high percentages of fine-material. The fine-material content, according to BMN <200 mesh, can be kept beneath 14%, preferably beneath 10%.

Figure 11:
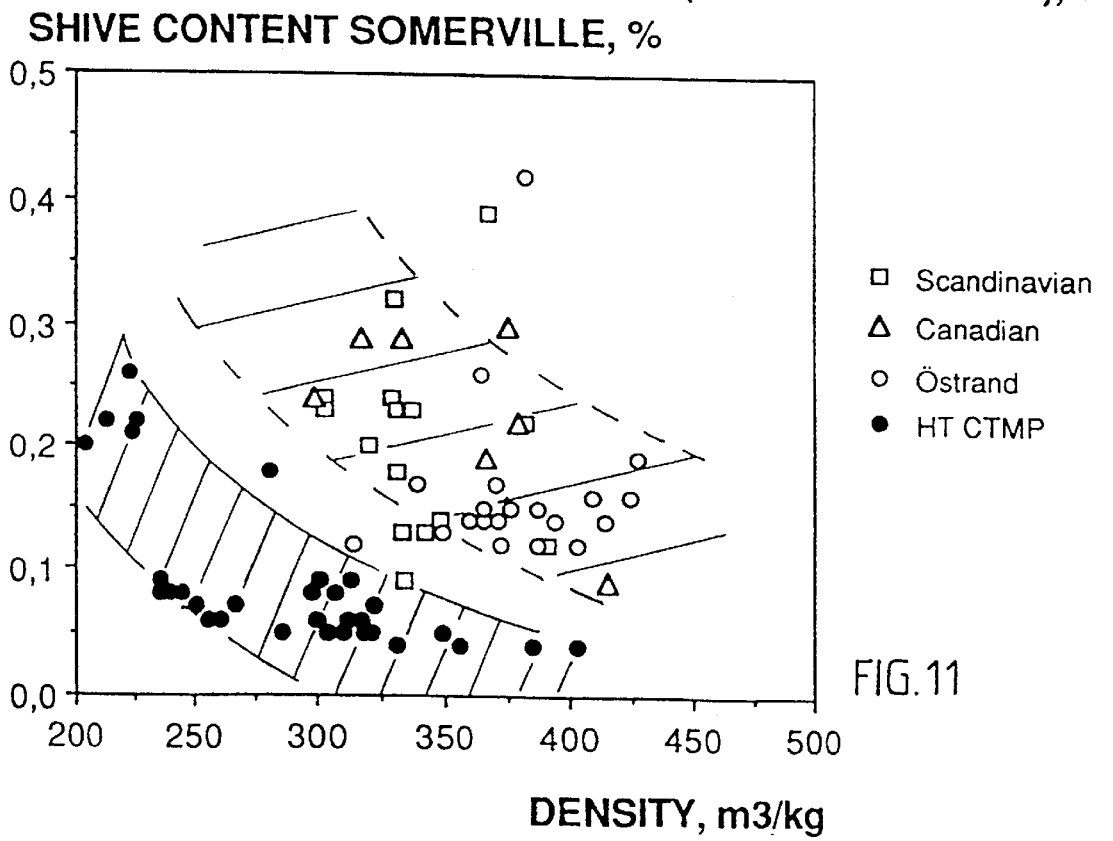
FIG. 11 shows the shive content as a function of the density.

FIG. 11 shows the shive content as a function of the density. Very high bulk levels (density lower than 275 $kg/m^3$) can be achieved with extremely low shive contents in pulps produced in accordance with the invention (less than 0.3%, preferably less than 0.10%, according to analyses with Somerville screens), which is necessary in order to be able to use the pulps in products in which high demands are placed on the purity or surface smoothness of the product. When manufacturing CTMP-type mechanical pulps using present day techniques it is not possible to obtain the highest bulk levels (the lowest densities) and sufficiently low levels of shive contents at one and the same time.

Figure 12:
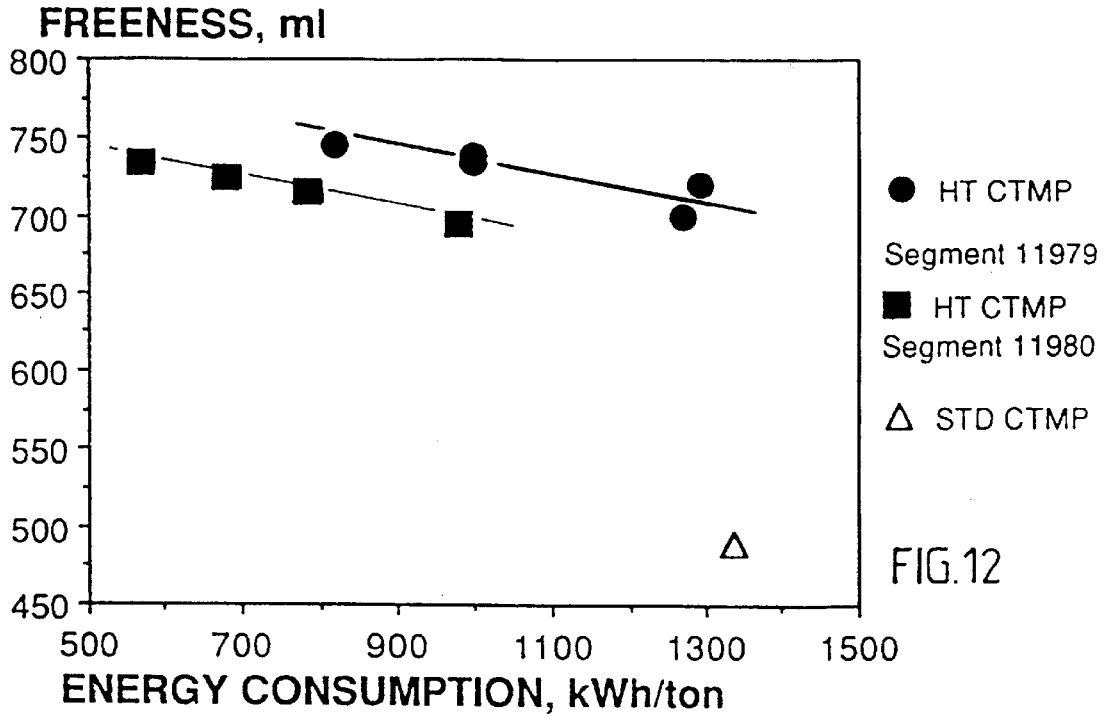
FIG. 12 illustrates freeness as a function of energy consumption.

FIG. 12 illustrates freeness as a function of energy consumption. When practicing the present invention it is possible to maintain a high level of freeness with low contents of fine-material even when the energy input is relatively high.

Figure 13:
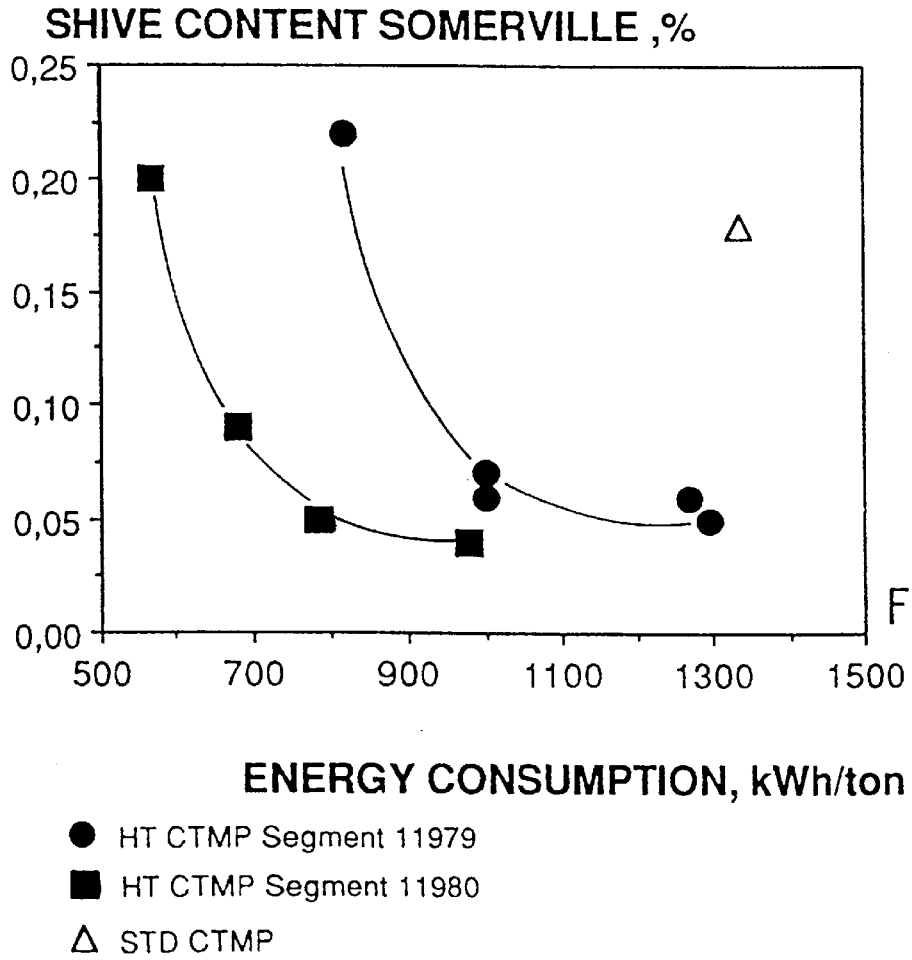
FIG. 13 shows the shive content as a function of energy consumption.

FIG. 13 shows the shive content as a function of energy consumption. A low shive content can be achieved with a low energy input, when practicing the inventive method.

Figure 14:
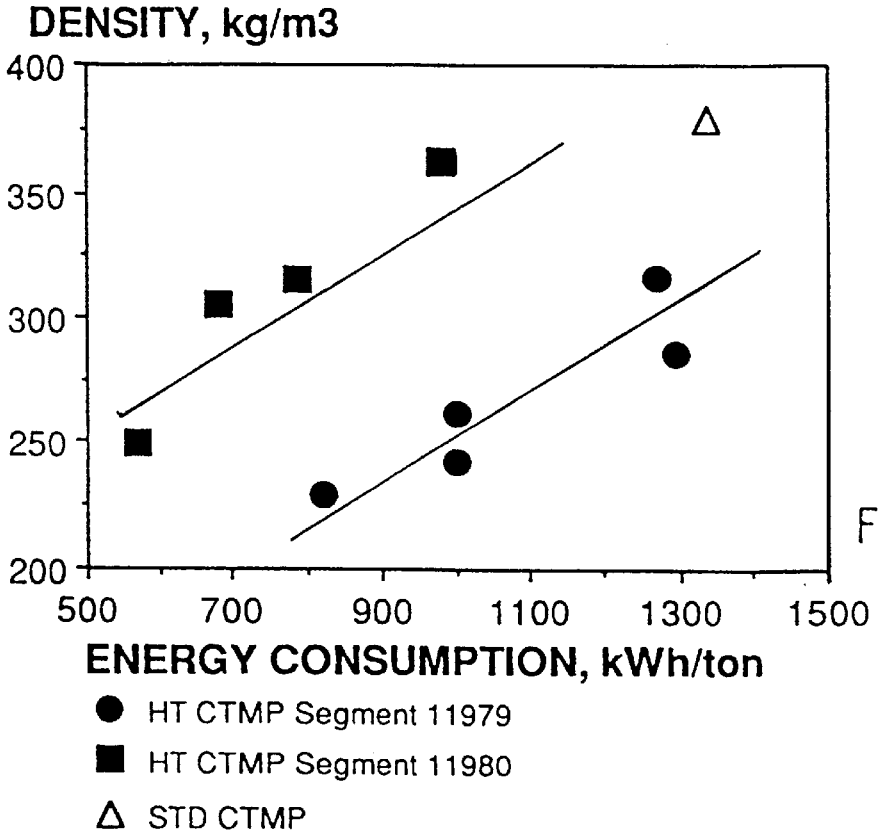
FIG. 14 shows density as a function of energy consumption.

FIG. 14 shows density as a function of energy consumption. A low density can be achieved with a low energy input when practicing the inventive method.

Figure 15:
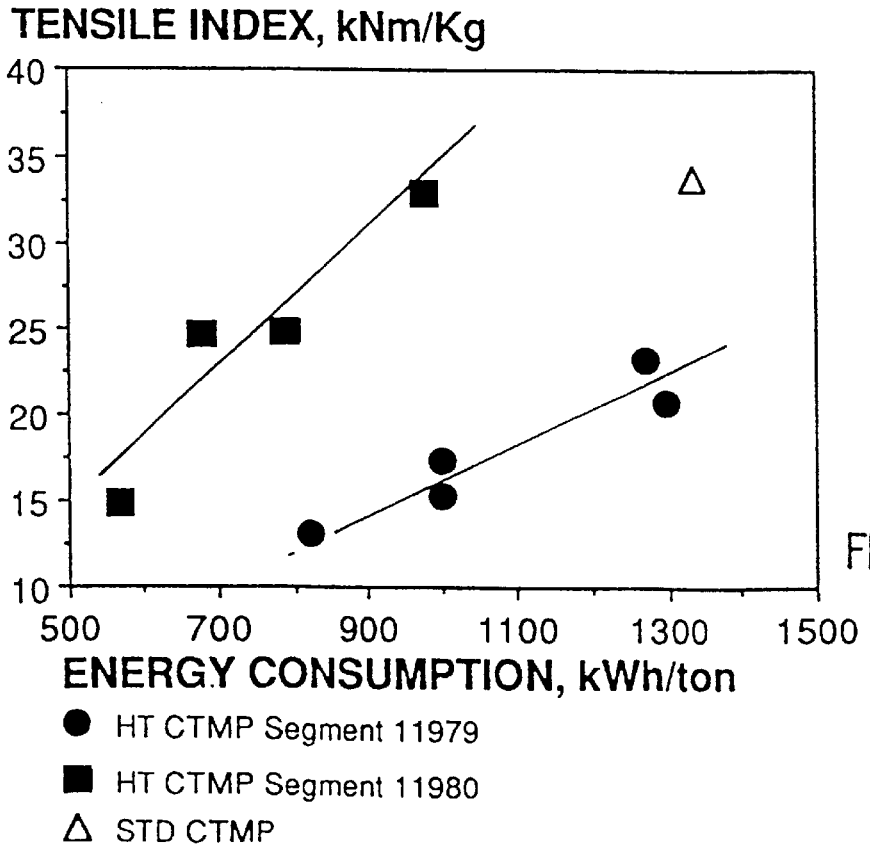
FIG. 15 illustrates tensile index as a function of the energy consumption.

FIG. 15 illustrates tensile index as a function of the energy consumption. A high mechanical strength can be achieved with a low energy input when practicing the inventive method.

The inventive pulps illustrated in FIGS. 5–11 have been produced at different energy consumption or inputs. The lower shive contents shown in FIGS. 5–7 and in FIG. 11 correspond to high energy inputs (with the same type of refining segment) at the same values of freeness, fine-material content, long fiber content and density respectively. In FIGS. 8–10, the higher tensile index, density and Scott Bond value respectively correspond to a higher energy input (with the same type of refining segment) at the same fine-material content.

FIGS. 12–15 show that the pulp properties can be controlled by the energy input in the various refining stages with a refining segment of given design. When producing pulp in accordance with the present invention (HT CTMP) the energy consumed in obtaining the desired properties are much lower than when producing conventional CTMP chemimechanical pulps using present day techniques, when the refining segment is appropriately designed or configured. The energy comparison has nevertheless been made with the most energy-lean technique for manufacturing conventional CTMP, where refinement has been effected in a 52" twin-disk refiner operated at a speed of 1500 rpm. The energy consumption is still higher when manufacturing conventional or standard CTMP in plants which use single-disk refiners. The properties of CTMP manufactured in such plants are evident from FIGS. 5–15.

The properties of those pulps produced in accordance with the invention and intended for the manufacture of tissue are also described by data listed in Table 2. The properties of pulps (with equal shive contents) according to the invention have been compared in the table with corresponding properties of pulps manufactured in accordance with conventional chemimechanical techniques. This type of pulp intended for use in tissue or paperboard products for instance is often required to have a given highest shive content. The pulp produced in accordance with the invention (HT tissue) will contain much lower proportions of fine-material at a given shive content, and is also more bulky (has a lower density), has a higher drainability (has a higher freeness) and can be produced at much lower energy inputs than corresponding CTMP-type chemimechanical pulps produced in a conventional manner.

As will be evident from the Table, when practicing conventional techniques it is extremely difficult to obtain a shive content of 0.10% or lower in the freeness range above 400 ml, which is the most relevant range for the inventive pulps.

EXAMPLE 1

The pulps were produced in the plant described with reference to FIG. 2. Spruce chips were steamed atmospherically, compressed in a press screw and then impregnated with 3–5% sodium sulphite at a temperature of 170°–175° C. The chips were held in the impregnating liquor for about 1 minute. After impregnation, the chips were preheated in the same vessel in a steam atmosphere at a temperature of 170°–175° C. for about 1 minute prior to being refined in the first stage, which was carried out in a single disk refiner of the type RGP 242 at high consistency (about 30%) and at the same pressure and the same temperature as those applied in the preheating process. For these tests the refiner was equipped with two different types of refining disks (type 11979 or 11980 from the supplier Sunds Defibrator). After this initial refining stage, the pulp was blown to an atmospheric,. in other words non-pressurized, twin-disk refiner of the type RSB 1300, in which the pulp was refined in a second stage, which was also carried out at a high consistency (about 30%). A third refining stage was carried out at a low consistency (4–5%) in a Conflo-type low consistency refiner obtained from Sunds Defibrator (machine suppliers). A number of pulps were produced, these pulps being given individually specific properties by varying the energy inputs in the different refining stages. The different refining segments gave different relationships between energy consumption and pulp properties (see FIGS. 12–15). It was found that the freeness-value and the shive content decreased while the density and tensile index value increased with increasing energy input values. Table 3 presents data for the different pulps produced in accordance with the invention, which are compared in the table with pulps produced in the plant shown in FIG. 4 by means of a conventional CTMP-technique (STD CTMP).

The reference pulps were produced from the same type of spruce chips as those used in the tests carried out in accordance with the invention. The chips were impregnated with 2–5% sodium sulphite in an atmospheric impregnating stage and then preheated to a temperature of 135° C., i.e. to the lignin softening temperature. The pulp was refined in a first pressurized stage at a high pulp consistency (30%) in an

TABLE 2

Comparison of the properties of pulps intended for tissue manufacture from spruce chips according to the invention (HT tissue) and conventional CTMP-type chemimechanical pulp. The comparison was made at identical shive content levels.

| | HT TISSUE | | | CONVENTIONAL TISSUE | | |
|---|---|---|---|---|---|---|
| Shive Somerville % | 0,25–0,15 | 0,15–0,10 | 0,10–0,04 | 0,25–0,15 | 0,15–0,10 | <0,10 |
| Fine-material according to Bauer McNett <200 mesh % | 1–10 | 2–10 | 4–14 | 12–20 | 13–20 | — |
| Density kg/m$^3$ | 200–275 | 210–325 | 225–400 | 300–425 | 325–425 | — |
| Tensile Index kNm/kg | 10–20 | 11–27 | 12–40 | 22–42 | 25–42 | — |
| Freeness ml | 750–720 | 740–700 | 730–650 | 650–400 | 600–400 | — |
| Refining kWh/ton | 300–600 | 400–800 | 500–1200 | 1100–1400[1)] | 1200–1400[1)] | — |

[1)]According to the most electric energy effective technique known at present time, with refinement in double disc refiners.

RSB 1300 type twin-disk refiner at the same temperature as the preheating temperature. The pulp was then refined in a second stage in a Conflo-type low consistency refiner under the same conditions as those applied when producing HT CTMP.

EXAMPLE 2

Pulps were also produced in accordance with the invention under the same conditions as those reported in Example 1, but with the exception that the second high-consistency refining stage was excluded. Instead, the pulp was blown from the first refining stage directly to a vessel in which the pulp was thinned for refinement in a Conflo-type low-consistency refiner. The properties of the pulps produced are set forth in Table 4. The results show that inventive pulps can also be produced in accordance with this method.

EXAMPLE 3

Pulps were produced in accordance with the invention under the same conditions as those reported in Example 1 with the exception that the third low-consistency refining stage was omitted. The properties of the pulps produced are set forth in Table 5. The results show that pulps according to the invention can also be produced by this method.

TABLE 4

Refining in two stages.
High consistency + low consistency

| | | HT-CTMP | STD CTMP |
|---|---|---|---|
| Impregnation | | | |
| $Na^2SO^3$ | kg/t | 35 | 35 |
| NaOH | kg/t | 0.5 | 1.5 |
| DTPA | kg/t | 1,5 | 1,7 |
| Preheating | | | |
| Pressure in stage 1 | kPa | 755 | 230 |
| Temperature in stage 1 | °C. | 170 | 135 |
| Pressure in stage 2 | kPa | atm | atm |
| Refining | | | |
| Segment stage 1 | | 11980 | SK720 |
| Segment stage 2 | | | |
| Energy input stage 1 | kWh/t | 360 | 1080 |
| Energy input stage 2 | kWh/t | | |
| Energy input Confio | kWh/t | 210 | 180 |
| Energy input reject | kWh/t | | 75 |
| Energy input total | kWh/t | 570 | 1335 |
| Test results | | | |
| Mean value number of samples | | 4 | 13 |
| Freeness CSF | ml | 735 | 490 |

TABLE 3

The mean values from test runs when refining in three stages, in comparison with standard CTMP

| | | HT CTMP | | | | | | | STD CTMP |
|---|---|---|---|---|---|---|---|---|---|
| Impregnation | | | | | | | | | |
| $Na^2SO^3$ | kg/t | 35 | 35 | 35 | 35 | 35 | 35 | 35 | 35 |
| NaOH | kg/t | 0.5 | 0.5 | 0.5 | 0.5 | 0.5 | 0 | 0 | |
| DTPA | kg/t | 1.5 | 1.5 | 1.5 | 1.5 | 1.5 | 1.5 | 1.5 | 1.7 |
| Preheating | | | | | | | | | |
| Pressure in stage 1 | kPa | 755 | 755 | 755 | 755 | 755 | 755 | 755 | 230 |
| Temperature in stage 1 | °C. | 170 | 170 | 170 | 170 | 170 | 170 | 170 | 135 |
| Pressure in stage 2 | kPa | atm | atm | atm | atm | atm | atm | atm | atm |
| Refining | | | | | | | | | |
| Segment stage 1 | | 11979 | 11979 | 11979 | 11979 | 11979 | 11980 | 11980 | SK720 |
| Segment stage 2 | | SK 720 | SK 720 | SK 720 | SK 720 | SK 720 | SK 720 | SK 720 | |
| Energy input stage 1 | kWh/t | 290 | 350 | 350 | 360 | 365 | 300 | 330 | 1080 |
| Energy input stage 2 | kWh/t | 390 | 450 | 450 | 660 | 690 | 360 | 460 | |
| Energy input Confio | kWh/t | 140 | 200 | 200 | 250 | 240 | 125 | 190 | 180 |
| Energy input reject | kWh/t | | | | | | | | 75 |
| Energy input total | kWh/t | 820 | 1000 | 1000 | 1270 | 1295 | 785 | 980 | 1335 |
| Test results | | | | | | | | | |
| Mean value number of samples | | 6 | 5 | 2 | 4 | 3 | 5 | 3 | 13 |
| Freeness CSF | ml | 745 | 735 | 740 | 700 | 720 | 715 | 695 | 490 |
| Shive Somerville | % | 0.22 | 0.22 | 0.07 | 0.06 | 0.05 | 0.05 | 0.04 | 0.18 |
| Shive Pulmac | % | 0.44 | 0.13 | 0.17 | 0.09 | 0.1 | 0.06 | 0.06 | |
| BMcNett | | | | | | | | | |
| >30 mesh | % | 72.8 | 69.5 | 65.3 | 62.2 | 67.4 | 68.9 | 66.3 | 61.2 |
| <200 mesh | % | 5.8 | 9.0 | 10.3 | 9.3 | 7.6 | 7.4 | 7.6 | 15.0 |
| Density | $kg/m^3$ | 229 | 242 | 262 | 316 | 286 | 315 | 363 | 379 |
| Tensile Index | kNm/kg | 13.1 | 15.3 | 17.4 | 23.3 | 20.7 | 24.8 | 32.9 | 33.8 |
| Tear Index | $Nm^2/kg$ | 4.8 | 6.2 | 6.0 | 7.3 | 7.6 | 10.4 | 9.3 | 9.4 |
| Scott-Bond | $J/m^2$ | 30 | 34 | 39 | 57 | 39 | 48 | 67 | 69 |
| Brightness | % | 72.5 | 76.1 | 74.8 | 75.4 | 75.1 | 77.2 | 77.3 | 77.7 |
| Kajaani FS-100 weighed | mm | 2.29 | 2.29 | 2.19 | 2.00 | 2.24 | 2.40 | 2.10 | |
| Kajaani FS-100 <0.11 | % | 25.63 | 24.38 | 25.57 | 25.61 | 24.21 | 35.91 | 30.17 | |
| DCM | % | 0.1 | 0.09 | 0.009 | 0.09 | 0.06 | 0.07 | 0.07 | 0.08 |

TABLE 4-continued

| Refining in two stages. High consistency + low consistency | | HT-CTMP | STD CTMP |
|---|---|---|---|
| Shive Somerville | % | 0.20 | 0.18 |
| Shive Pulmac | % | 0.46 | |
| BMcNett | | | |
| >30 mesh | % | 53.1 | 61.2 |
| <200 mesh | % | 11.0 | 15.0 |
| Density | kg/m$^3$ | 249 | 379 |
| Tensile Index | kNm/kg | 14.9 | 33.8 |
| Tear Index | kNm$^2$/kg | 4.6 | 9.4 |
| Scott-Bond | J/m$^2$ | 39 | 69 |
| Brightness | % | 67.1 | 77.7 |
| Kajaani FS-100 weighed | mm | 1.90 | |
| Kajaani FS-100 <0.11 | % | 2362 | |
| DCM | % | 0.11 | 0.08 |

TABLE 5

| Refining in two stages at high consistency | | HT-CTMP | STD CTMP |
|---|---|---|---|
| Impregnation | | | |
| $Na^2SO^3$ | kg/t | 35 | 35 |
| NaOH | kg/t | 0 | 1.5 |
| DTPA | kg/t | 1.5 | 1.7 |
| Preheating | | | |
| Pressure in stage 1 | kPa | 755 | 230 |
| Temperature in stage 1 | °C. | 170 | 135 |
| Pressure in stage 2 | kPa | atm | atm |
| Refining | | | |
| Segment stage 1 | | 11980 | SK720 |
| Segment stage 2 | | SK 720 | |
| Energy input stage 1 | kWh/t | 300 | 1080 |
| Energy input stage 2 | kWh/t | 380 | |
| Energy input Confio | kWh/t | | 180 |
| Energy input reject | kWh/t | | 75 |
| Energy input total | kWM | 680 | 1335 |
| Test results | | | |
| Mean value number of samples | | 4 | 13 |
| Freeness CSF | ml | 725 | 490 |
| Shive Somerville | % | 0.09 | 0.18 |
| Shive Pulmac | % | 0.15 | |
| BMcNett | | | |
| >30 mesh | % | 66.8 | 61.2 |
| <200 mesh | % | 8.9 | 15.0 |
| Density | kg/m$^3$ | 305 | 379 |
| Tensile Index | kNm/kg | 24.7 | 33.8 |
| Tear Index | Nm$^2$/kg | 8.5 | 9.4 |
| Scott-Bond | J/m$^2$ | 52 | 69 |
| Brightness | % | 76.0 | 77.7 |
| Kajaani FS- 100 weighed | mm | 2.20 | |
| Kajaani FS-100 <0.11 | % | 26.95 | |
| DCM | % | 0.08 | 0.08 |

Literature

The lignin softening temperature:

1. Atack, D., Svensk Papperstidning 75 (3):89 (1972)
2. Höglund, H. and Sohlin, U.; "The effect of physical properties of the wood in chip refining", Proceedings 1975, Intrnational Mechanical Pulping Conference, San Francisco, San Francisco, Jun. 16–20, p 77–85.
3. Salmén, L.: "Viscoelastic properties of in situ lignin under water saturated conditions", Journal of Materials Science 19 (1984), p 3090–3096.
4. Salmén, N. L. and Fellers, C.: "The fundamentals of energy consumption during viscoelastic and plastic deformation of wood", Journal Pulp Paper Science TR93–99 (1982).
5. Becker, H., Höglund, H. and Tistad, G.: "Frequency and temperature in chip refining" Paperi ja Puu 59 (1977), No. 3, p 123.

Lignin softening temperature after chemical softening:

6. Atack, D. and Heitner, C.: "Dynamic mechanical properties of sulfonated eastern black spruce" Proceedings 1979, International Mechanical Pulping Conference, Technical Section CPPA, Jun. 1979, p. 1–12.
7. Heitner, C. and Atach, D.: "Dynamic mechanical properties of sulphite treated aspen" Paperi ja Puu, No 2 (1984), p 84–89.
8. Corson, S. R. and Fontebasso, J.: "Visco-elastic energy absorption of sulfonated radiata pine" Appita Vol. 43, No. 4, p 300–304.

Reference mill and system descriptions

9. CTMP, Brochure from Sunds Defibrator (334–167 E 01.83)
10. First CTMP-mill in Norway, Norsk Skosindustri, No. 9, 1984, p 40–44.
11. Sharman, P. M.: Pulp & Paper, Vol 63, No. 5, May 1989, p S2–S32.

| Test methods | | |
|---|---|---|
| Shive content Somerville | TAPPI | UM 242 |
| Freeness | SCAN | M4:65 |
| Bauer McNett | SCAN | M6:69 |
| Manufacture of laboratory sheets | SCAN | M5:76 |
| Tensile index | SCAN | M8:76 |
| Density (bulk) | SCAN | M8:76 |
| Scott Bond | TAPPI | UM 403 |

We claim:

1. A high drainability chemimechanical pulp for use in the manufacture of paper or paperboard products where a high bulk is desired, wherein the pulp is produced from lignocellulosic fiber material at a yield above 88%, and has an extract content of less than 0.15% calculated as dichloromethane extractable resin, a high long fiber content, a low fine-material content and a low shive content, the pulp having been produced by refining impregnated and preheated chips in one stage or in several stages in series, wherein the first or sole stage, respectively, is effected at a temperature of 150°–190° C. and above the lignin softening temperature, and wherein when fractionating according to Bauer McNett the long fiber content of fibers retained on a 30 mesh wire cloth is between 60 and 75%; when fractionating according to Bauer McNett the fine-material content of fibers that pass through a 200 mesh wire cloth is at most 14%; the pulp is refined to a freeness of 600 ml CSF at the lowest; the shive content is lower than 0.5%; the pulp density ranges between 200 and 400 kg/m$^3$; and the tensile index of the pulp is at least 10 kNm/kg.

2. A pulp according to claim 1, wherein the long fiber content is between 62 and 72%.

3. A pulp according to claim 2, wherein the long fiber content is between 63 and 70%.

4. A pulp according to claim 1, wherein the fine-material content is at most 11%.

5. A pulp according to claim 4, wherein the fine-material content is at most 9%.

6. A pulp according to claim 1, wherein the shive content is at most 0.15%.

7. A pulp according to claim 6, wherein the shive content is at most 0.10%.

8. A pulp according to claim 1, wherein the long fiber content is at least 65%; the fine-material content is at most 10%; the pulp is refined to a freeness of 650 ml CSF at the lowest; and the shive content is at most 0.10%.

9. A method of producing chemithermomechanical pulp (CTMP) which comprises:

a) impregnating chips of lignocellulosic fiber material with a hot lignin softening chemical solution having a temperature of at least 130° C., and selected from the group consisting of sodium sulphite, sodium dithionite, and alkaline peroxide;

b) preheating the chips at a temperature of 150°–190°and above the lignin softening temperature;

c) carrying out steps a) and b) in a total time period of at most 4 minutes; and d) refining the chips in one stage or in several stages in series, wherein the first or sole stage, respectively, is effected at essentially the same pressure and the same temperature as the preheating step; and effecting the refining step at a total energy input which is at least 50% and at most 90% of the energy input that is required to achieve the same shive content when preheating at 135° C. and using the same machine equipment;

said pulp having an extract content of less than 0.15% calculated as dichloromethane extractable resin, a high long fiber content, a low fine-material content and a low shive content and wherein when fractionating according to Bauer McNett the long fiber content of fibers retained on a 30 mesh wire cloth is between 60 and 75%; when fractionating according to Bauer McNett the fine-material content of fibers that pass through a 200 mesh wire cloth is at most 14%; the pulp is refined to a freeness of 600 ml CSF at the lowest; the shive content is lower than 0.5%; the pulp density ranges between 200 and 400 kg/$M^3$; and the tensile index of the pulp is at least 10 kNm/kg.

10. A method according to claim 9, wherein the refining step is effected at a total energy input which is at least 60% and at most 80% of the energy input required to achieve the same shive content when preheating at 135° C. and using the same machine equipment.

11. A method according to claim 9, wherein the first refining stage is effected at a temperature of 160°–175° C., and the starting lignocellulosic fiber material is softwood.

12. A method according to claim 9, wherein softwood is used as the starting lignocellulosic fiber material, and the refining step is effected with a total energy input of at least 300 kWh/ton.

13. A method according to claim 12, wherein the refining process is effected with a total energy input of at least 600 kWh/ton.

14. A method according to claim 12, wherein the refining step is effected at a total energy input of at most 1200 kWh/ton.

15. A method according to claim 14, wherein the refining step is effected at a total energy input of at most 1000 kWh/ton.

16. A method according to claim 9, wherein the refining step is effected in at least three stages in series.

17. A method according to claim 9, wherein the pulp is refined in the first stage to a pulp consistency which is higher than 25%.

18. A method according to claim 17, wherein the pulp is refined in the first stage to a pulp consistency of about 30%.

19. A method according to claim 9, wherein the pulp is refined in a second refining stage at atmospheric pressure and to a pulp consistency which is higher than 25%.

20. A method according to claim 19, wherein the pulp is refined in the second refining stage to a pulp consistency of about 30%.

21. A method according to claim 9, wherein the pulp is refined in the last refining stage to a pulp consistency which is lower than 8%.

22. The method according to claim 21, wherein the pulp is refined in the last refining stage to a pulp consistency ranging between 4% and 6%.

* * * * *